US006315484B1

(12) United States Patent
Oates, Jr.

(10) Patent No.: US 6,315,484 B1
(45) Date of Patent: Nov. 13, 2001

(54) INFORMATION HANDLER AND PROJECT MANAGER

(75) Inventor: Robert M. Oates, Jr., Fairfield, IA (US)

(73) Assignee: Robert Oates, Faiffield, IA (US)

( * ) Notice: Subject to any disclaimer, the term of this patent is extended or adjusted under 35 U.S.C. 154(b) by 0 days.

(21) Appl. No.: 09/689,513

(22) Filed: Oct. 12, 2000

Related U.S. Application Data

(60) Provisional application No. 60/158,762, filed on Oct. 12, 1999.

(51) Int. Cl.[7] ..... B42F 13/00

(52) U.S. Cl. ..... 402/79; 402/80 R; 281/38; 281/31; 281/45; 283/61

(58) Field of Search ..... 402/79, 80 R; 281/31, 15.1, 22, 45, 38; 283/5, 30, 31, 36, 41, 42, 51, 61, 62, 117

(56) References Cited

U.S. PATENT DOCUMENTS

| | | | | |
|---|---|---|---|---|
| 4,016,664 | | 4/1977 | Kaufmann | 40/642.02 |
| 4,043,063 | | 8/1977 | Ambasz | 40/119 |
| 4,232,463 | | 11/1980 | Spees | 40/383 |
| 4,571,867 | * | 2/1986 | Williams | 402/79 |
| 4,803,795 | * | 2/1989 | Ouestel et al. | 402/79 X |
| 4,824,273 | | 4/1989 | Silwa | 402/79 |
| 4,907,904 | | 3/1990 | Baldwin | 402/80 R |
| 4,968,065 | | 11/1990 | O'Brien | 283/117 |
| 4,973,184 | | 11/1990 | La Salle | 402/70 |
| 5,026,196 | | 6/1991 | Brass | 402/79 |
| 5,029,903 | | 7/1991 | Pennock | 283/81 |
| 5,143,466 | | 9/1992 | Baldwin | 402/79 |
| 5,222,769 | | 6/1993 | Dyer | 281/45 |
| 5,294,208 | | 3/1994 | Trammel et al. | 402/70 |
| 5,421,665 | * | 6/1995 | Strassberg | 402/79 |
| 5,433,387 | | 7/1995 | de Boisse | 434/108 |
| 5,586,829 | | 12/1996 | Schwartz | 402/79 |

* cited by examiner

*Primary Examiner*—Willmon Fridie, Jr.

(57) ABSTRACT

An information handler, project manager and the like that includes one or more file sheet holders (16) with horizontally extended, vertically offset slits (18), as well as file sheets (22) that insert into the slits on each file sheet holder. A small portion of each file sheet is too wide to enter a slit. For smooth operation and durability in small embodiments, plasticized paper is used for both the file sheet holders and file sheets.

16 Claims, 3 Drawing Sheets

INFORMATION HANDLER AND PROJECT MANAGER

This application claims benefit to Ser. No. 60/158,762 Oct. 12, 1999.

CROSS-REFERENCE TO RELATED APPLICATIONS

Not applicable

BACKGROUND—Field of Invention

This invention relates to information handlers and project managers, specifically to such as allow rapid random access to stored information on a plurality of topics in a small and portable embodiment, making use of natural handwriting without the need for computers or other machinery.

BACKGROUND—Description of Prior Art

Desktop and portable appointment books and other such planners are always in demand. However, such appointment book planners have their strength only in time management. They do not allow for ready information intake and retrieval on a wide variety of topics. Nor do they allow for project planning and management. In short, they are time-management tools, not information handling/project management tools.

In recent years, the increasing popularity of the computer-based personal digital assistant (PDA) has emphasized the overly narrow focus of paper-based appointment book planners. A typical PDA not only offers appointment book and contact directory services, but also a random access note-taking system. This note-taking system commonly allows the user to input information and retrieve it again by title or key words. This information handling capability has enhanced the usability of the product, and led to increased expectations in the planner marketplace.

However, many people do not like to use these handheld computers for their daily planning tool. Many people simply do not feel comfortable with electronic technology for such a purpose, in part because it is difficult to input information on tiny keyboards or with fallible character-reading technologies, and the screens are typically difficult to read. These ergonomic failings erect a high barrier to rapid, easy use of PDAs as information-handling/project planning systems. They are also very expensive.

What is needed is a paper-based information-handling system that would allow users to input information naturally, by hand, using pencil or pen, and retrieve it again easily by title or key words. If in such a system notes could be taken immediately, by hand, anywhere, and filed quickly and easily, the ergonomic barrier to use of such an information handler and project manager would be broken. Information could be entered on the spot, inspirations could be recorded at the moment, and all of this useful data could be quickly retrieved whenever needed. Since the whole product would be made of paper, or paper-like products, moreover, the price would be modest.

Ideally such a system would be small and lightweight and would fit comfortably into an appointment book-style planner, even into the smallest shirt-pocket-sized planner. Users could then have a time management system, a contact directory and an information-handling/project planning system, all in a single, compact, handy tool. The smallest sizes, fitting into a shirt pocket, jacket pocket, purse or belt holster, could be carried at all times, for ready entry of information as it arises, and random access to all stored information at any time.

It is true that such an information handler and project manager could be a stand-alone product, and many users would prefer it that way. But the combination of my new information handler and project manager with a conventional appointment book and contact directory would add information management to time and contact management, creating a powerful tool for many people. In the design of such an information handling and project management system, therefore, the ability to comfortably fit all the above components into even a shirt-pocket sized planner should be a primary design feature.

The desire for a paper-based information handling system can be documented by the number of patents granted to various such devices. However, all prior patented inventions have had significant shortcomings, and none is now in wide use in the marketplace.

The intensity of the desire for a paper-based system for storing and retrieving information is perhaps best shown by U.S. Pat. No. 4,968,065 to O'Brien (1990) which shows a single note card of shirt-pocket-size with rounded corners and lines imprinted on one side for writing. That such a simplistic attempt should have undergone and survived the patent process attests to the strong desire among many people for a non-mechanical system of information storage and retrieval, but the isolated and unorganized nature of such individual note cards makes this invention of extremely limited use.

The shirt-pocket-sized format is again addressed in U.S. Pat. No. 4,016,664 to Kauffmann in 1977 which shows a thin container which contains a number of small sheets, one of which fits on the firm flat surface of the container. This is useful for a To Do list, or other single purposes, but cannot be used to store and quickly retrieve a large number of sheets containing information on different topics. Another shirt-pocket-sized system, U.S. Pat. No. 5,222,764 to Dyer in 1993, shows larger sheets with inprinted sub-spaces for particular types of information, which sheets fold down and fit in a special wallet. But such multiply folded sheets do not allow rapid scanning of, and access to, the stored information.

The desire for multiple receptacles for multiple information-containing sheets is exemplified by U.S. Pat. No. 5,586,829 in 1996 to Schwartz which shows one sheet of material folded back on itself in a complex way such that three vertically offset pockets are created to contain suitably sized sheets, the whole to be inserted in a notebook or other holder. This invention, however, is unwieldy even at large size and could never yield a large number of sheet-holders in a small, shirt-pocket-sized embodiment. Similarly, U.S. Pat. No. 4,824,273 to Silva in 1989 shows clear plastic envelopes of various sizes to hold paper sheets and other objects, also contained in a notebook, an approach which does not yield easy access to information-containing sheets at any size and which would not work at all at shirt-pocket size, due to the thickness of the clear plastic envelopes. Again, U.S. Pat No. 4,043,063 to Ambasz in 1977 shows a single sheet with a glued flap forming a pocket to hold one or more sheets within it, contained in a notebook, but such a simplistic system does not allow the tops of many file sheets to be visible one above the next, for rapid scanning of titles or key words and thus has severely limited use as a filing system for large numbers of sheets.

A number of patents have been issued based on paper sheets that are releasably glued in the manner of Post-It notes, including U.S. Pat. No. 5,294,208 to Trammel and Cushing in 1994, U.S. Pat. Nos. 4,973,184 to LaSalle in 1990, 4,907,904 to Baldwin in 1990, 5,143,466 also to Baldwin in 1992, 5,026,196 to Brass in 1991, 5,443,387 to deBoisse in 1995, and 5,029,903 to Pennock in 1991. None of these patented systems has had an impact in the marketplace, largely due to the inherent limitations of the releasably glued sheet for such a purpose. Such sheets (1) cannot be used over long periods without losing their adhesive strength, (2) tend to a loose, sloppy, dog-eared appearance with use, and (3) cannot be used in large numbers in a small, shirt-pocket-sized product without overlapping the sheets, and overlapping of the sheets means that individual sheets cannot be easily removed and refiled.

Two large-size systems offer access to a large number of information-containing media. One, U.S. Pat. No. 4,232,463 to Spees in 1980, is wall-mounted, made of two sheets of thick and durable materials, fitted together, which are slitted and permanently dented in such a way as to create a series of pockets which receive individual cards or sheets which slide down and are stopped by said permanent dents, held with the top of the card or sheet still showing. This product was designed to store microfiche, and its heavy and complex construction could never be adapted to a portable system an individual could carry, let alone to shirt-pocket size.

The second system, U.S. Pat. No. 4,571,867 to Williams in 1986, shows a portfolio approximately 9 inches by 12 inches in size which opens to reveal V-shaped slits in a thick but flexible material that also contains a permanent "pinch crease" to facilitate the opening of the partially V-shaped slits. "Information vehicles" such as memo cards are inserted into these slits and the slits are so placed as to allow long columns of memo cards one below the other, each with its top showing to reveal a space for writing the title of the card, or key words as to the cards' informational content. This design does allow the user random access to approximately 40 different memo cards by title or key words, but the design requires a thick, flexible material which must be backed by stiff boards, the whole requiring a 9×12 portfolio format. The most successful of all the inventions so far patented, this product had a life in the marketplace of approximately a decade, revealing consumer desire for such a random access, pen-and-paper information storage and retrieval system. However, its large size, thick material and awkward pinch crease mechanism made the system bulky and awkward to use, and did not allow users to keep the product with them, in shirt-pocket, purse, or belt holster, at all times. It is essential for an information storage and retrieval system intended for use in daily life, both at work and in private life, to be small, light and durable, with a high capacity for information sheets combined with a nearly effortless useability.

SUMMARY

In accordance with the present invention, an information handler and project manager comprises:

(a) file sheets of suitable material and size, (b) a file sheet holder of suitable material and size created with at least one column of vertically offset, horizontally extended and substantially horizontally aligned slits for removably storing said file sheets, and (c) a suitable means for preventing said file sheets from slipping entirely through said slits, and for maintaining the top edge of said file sheets above and outside said slits, whereby a title or key words for each said file sheet may be kept above said slits for easy visibility.

OBJECTS AND ADVANTAGES

Several objects and advantages of the present invention are:

(a) to provide a system for information handling and project management that allows users to use the natural, comfortable technique of hand-writing in a system that allows quick, effective storage and retrieval, the whole so ergonomically efficient that information handling becomes as easy as jotting down, and then looking up, an appointment in an appointment book;

(b) to provide a system for information handling and project management that is small and lightweight, even so small as to fit in a shirt-pocket-sized planner that could also include an appointment book and a telephone contact file, the whole to fit in a shirt pocket, jacket pocket, purse or belt holster;

(c) to provide a system for information handling and project management that allows titles or key words to be easily visible, for rapid random-access scanning by the user;

(d) to provide a system for information handling and project management that is smooth in operation, resistant to water and oil, and durable enough to endure heavy use without wrinkling, tearing or otherwise degrading;

(e) to provide a system for information handling and project management that flexibly allows large amounts of information to be stored on a single topic;

(f) to provide a system for information handling and project management that scales up from shirt-pocket planners through the various sizes of desk-top planners and, with the use of different materials, to easel-mounted, wall-mounted and other such large embodiments of the same invention;

(g) to provide a system for information handling and project management that allows larger desk-top systems to be used as long-term alphabetized storage for outdated file sheets that had been used in other systems;

(h) to provide a system for information handling and project management that is simple to manufacture, using common techniques for die-cutting and printing, as well as inexpensive, being paper-based, thus allowing for generous mark-ups to a final price that will still be many times lower than the price for computer-based PDAs;

(i) to provide a system for information handling and project management that is easily reparable, even if damaged;

(j) to provide a system for information handling and project management that is inherently neat and orderly in appearance, that is made of material with a rich and smooth feel, and that can be imprinted in any fashion to increase attractiveness and usability;

(k) to provide a system for information handling and project management that allows the user to plan and track individual projects, writing down and storing for repeated retrieval such information as steps of the project, deadlines for different steps, personnel involved, contact information, etc.;

(l) to provide a system for information handling and project management that provides a single, compact, always accessible system wherein users can file handwritten information on any business or personal topic, thus reducing the amount of notated information that is misplaced or lost;

(m) to provide a system for information handling and project management that can produce a benefit to individuals and to society as a whole, by increasing the effectiveness and productivity of the individuals who use it, just as computer-based random access information handling systems have increased the effectiveness and productivity of the individuals who use them.

DRAWING FIGURES

There are three figures presented.

REFERENCE NUMERALS IN DRAWINGS

Figure 1:
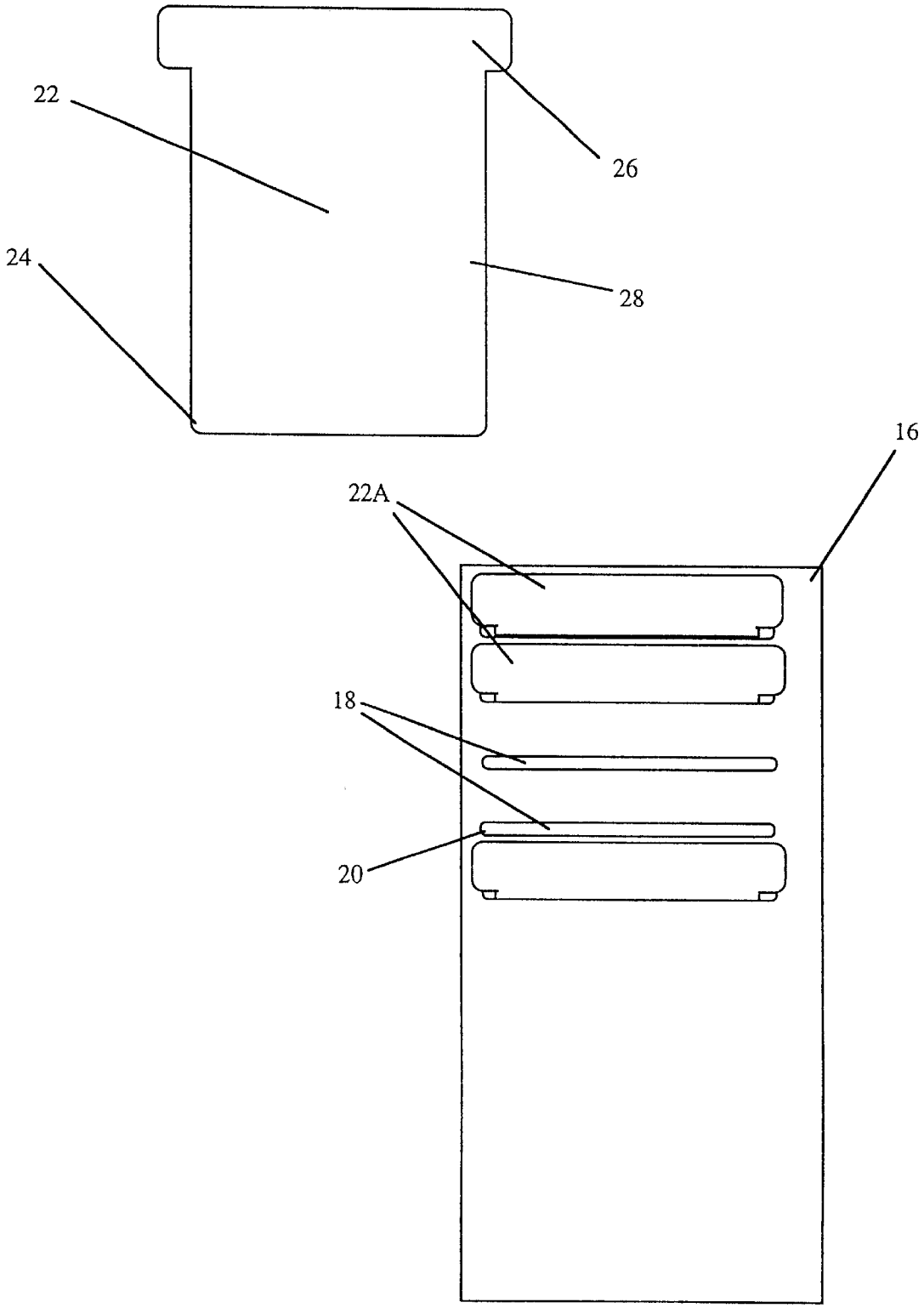
FIG. 1 shows a file sheet, above, and a file sheet holder with file sheets inserted in several of the available slits.

16 file sheet holder
18 slits in file sheet holder
20 rounded corners of slits
21 rounded holes for binding
22 file sheet
22A file sheets inserted in slits
24 rounded corner of file sheet
26 non-insertion portion of file sheet
28 insertion portion of file sheet
30 two-sided file sheet holder
32 fold on two-sided file sheet holder
34 binding edges of two-sided file sheet holder
36 flap to fold between the sides of the two-sided file sheet holder

Figure 2:
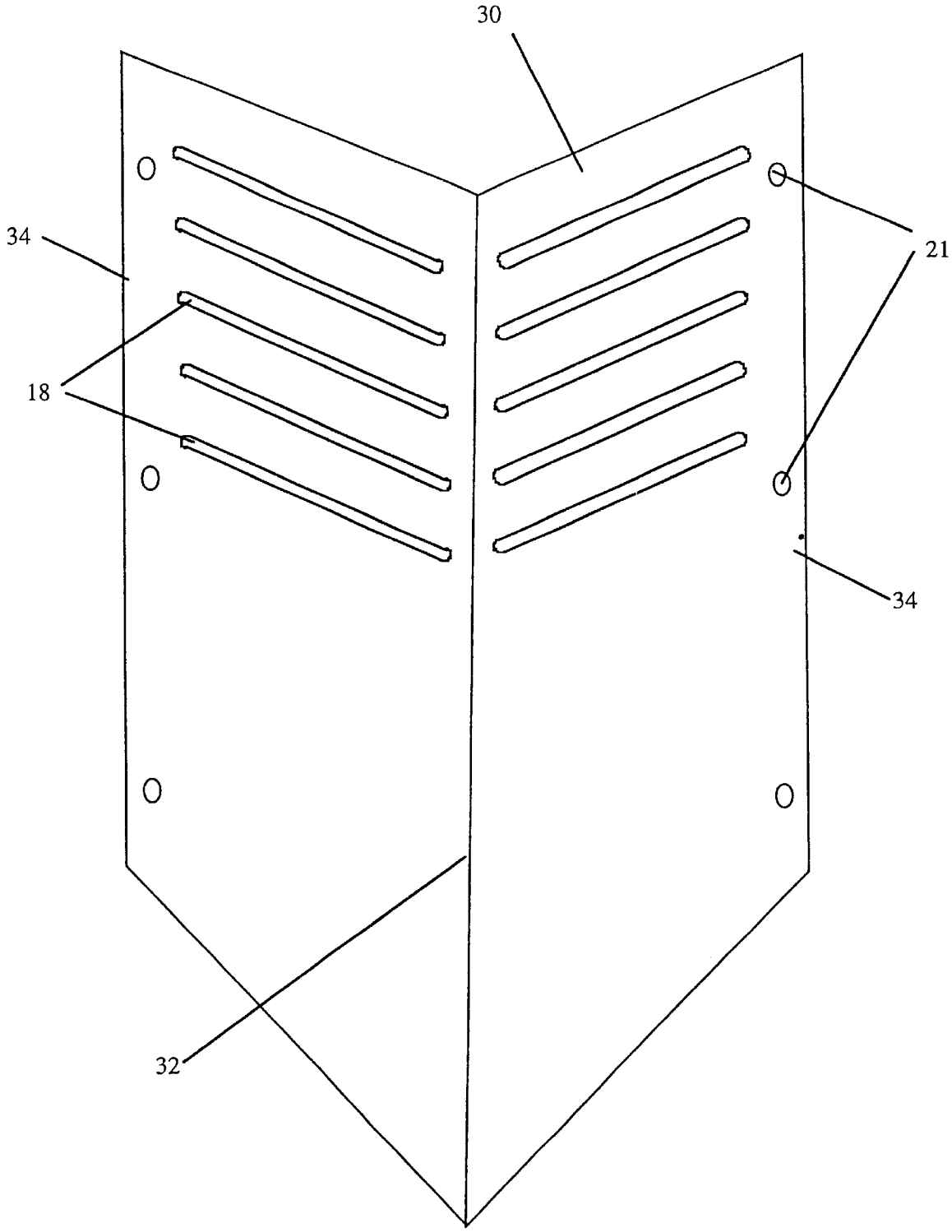
FIG. 2 shows a double-sided file-sheet holder on its own, folded at the center, with slits opened on both the left and right, or front and back, sides, the whole intended for insertion into a binder featuring metal rings; the invention, however, is independent of the type of binding, and of binding altogether.

DESCRIPTION—FIG. 1 and 2—Preferred Embodiment

A preferred embodiment of the present invention is illustrated in FIG. 1 and FIG. 2. FIG. 1 shows the basic elements. In this preferred embodiment, to be packaged in a binder, wallet, appointment book or the like, the invention has at least one paper or paper-like and paper-thin file sheet holder 16 that is die-cut with a plurality of vertically offset, horizontally extended and substantially horizontally aligned slits 18. The slits are substantially parallel horizontally and vertically offset by substantially equivalent distances. The slits have rounded ends 20, and holes for any binding are also rounded, as in FIG. 2, 21 to inhibit the file sheet holder from ripping or tearing under stress.

In like manner, in this preferred embodiment, the file sheets 22, shown in FIG. 1, are made of similar paper or paper-like and paper-thin material. The file sheets are die-cut into a T-top shape. This T-top section of the file sheet is referred to as the non-insertion portion of the file sheet 26. The remainder of the file sheet is narrower than the slits in the file sheet holder, and is known as the insertion portion of the file sheet 28. The T-top shape of the non-insertion portion is wider than the slit. When the insertion portion of the file sheet slides into the slit, the non-insertion portion does not fit through the slit, such that the non-insertion portion file sheet remains above or outside the slit 22A.

The file sheet has all corners rounded off 24, to inhibit folding and dog-earing and to allow the file sheet to slip easily into the slits. The vertically offset arrangement of the slits in the file sheet holder allows the T-top non-insertion portion of each of the file sheets to be completely visible, one below the next 22A. This allows the user to easily scan all the titles, or key words, of all the file sheets filed in the file sheet holder.

As in FIG. 2, in this preferred embodiment, each file sheet holder is two-sided 30. This two-side file sheet holder is die-cut in its outer dimensions, then machine folded once, with the fold 32 parallel to the edges prepared for binding 34. When bound, the folded side lies out, away from the binding. The open opposite sides are prepared for binding by die-cutting with holes 21 for ring or spiral binding, or otherwise prepared for binding. After the fold has been executed, a plurality of slits 18 as above is die-cut through both sides of the folded file sheet holder, thereby allowing file sheets to be inserted and removably stored on both sides of the file sheet holder.

In this preferred embodiment, my information handler and project planner can be enclosed in any suitable wallet or cover and bound with any suitable binding, including ring binding, wiro binding, spiral binding, saddle-stitching and smythe-sewn binding. For such a purpose, in the preferred embodiment, the file sheets and file sheet holders are made from plasticized paper, also known as plastic paper or polymer paper, such as POLY ART paper available from Bradner Smith in Chicago, or KIMDURA paper available from R. R. Donnelley in Crawfordsville, Ind. This platicized paper is thin and lightweight like paper, and it accepts pencil and ball point ink smoothly and permanently, with no smearing. In addition, plasticized paper strongly resists wrinkling, folding and tearing, and it is not permeable by water or oil. It also has an attractive, smooth feel. It is this platicized paper that allows this invention to be durably embodied in small, slim sizes, down to and including the smallest version that is thin enough to combine with a week-by-week appointment book and a contact directory and still fit in a shirt pocket.

Additional Embodiments and Variations

The basic invention is independent of size, number of columns of slits per page, size and shape of file sheets, materials and manufacturing equipment used and many other features. Other features, embodiments and variations considered as part of this invention include but are not limited to the following:

(a) The invention can be made in a wide variety of sizes. One of the most practical sizes fits in a shirt pocket and includes file sheets that are approximately three inches wide and four inches long. This compact size will accommodate three or more two-sided file sheet holders, with 30 or more slits for removably storing file sheets, along with a week-by-week or month-by-month appointment book and a contact directory. However, this invention is also practicable and useful in larger sizes, capable of fitting into larger appointment books and other such planners, up to the largest desk-top sizes. In the larger sizes either the size of the file sheets increases, or the file sheet holder is manufactured to comprise two or more vertical columns of slits, or both. This invention is also practicable and useful in yet larger sizes, in easel-mounted, wall-mounted and other such embodiments, made in suitable materials.

(b) Although this invention combines powerfully with an appointment book and a contact directory, to provide one integrated tool for information handling, project planning, time management and contact retrieval, it can also stand alone as an independent product.

(c) Larger desk-top versions of this invention can be made not only for original use, but also as storage systems for keeping outdated file sheets. This could include a suitable alphabetizing system, and a ring-binder or other system that allows free insertion of file sheet holders at any time at any place in the alphabetizing system. Such a flexible embodiment of the invention would provide long-term memory by allowing a large number of outdated file sheets to be removed from more portable embodiments and stored for easy retrieval at any point in the future.

Figure 3:
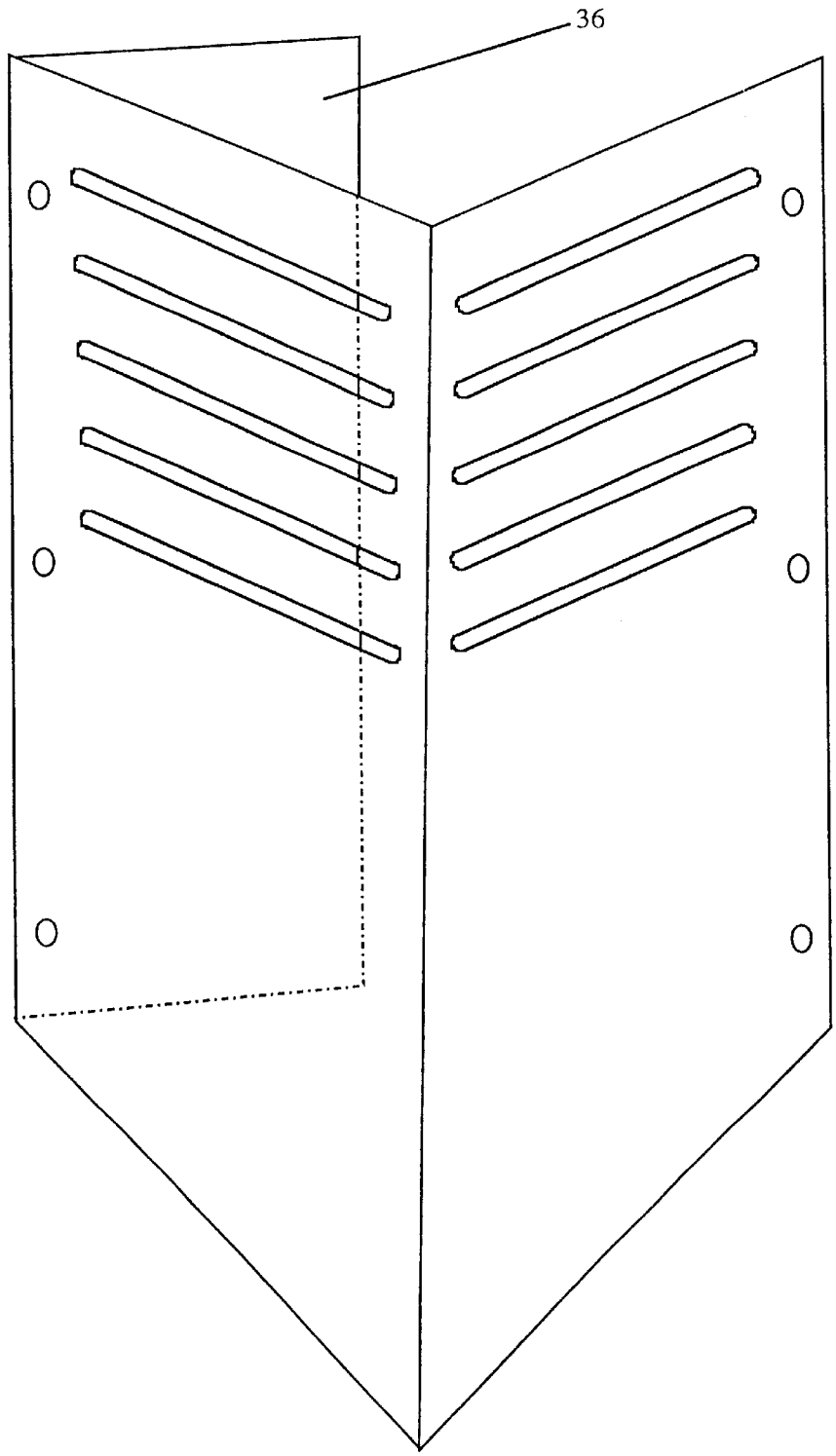
FIG. 3 shows a system whereby a flap can be folded between the two sides of a double-sided file sheet, such flap intended to prevent a file sheet which is inserted through a slit on one side of the file sheet holder from emerging through a slit on the other side, a system which facilitates easier insertion of file sheets into slits in file sheet holders.

(d) As in FIG. 3, a two-sided file sheet holder can be made with an extra flap 36 that folds inside, between the two sides of the file sheet holder. The extra flap could be folded in from the binding side, as shown in FIG. 3, or down from the top or up from the bottom of either of the two sides. When folded inside, the flap separates the two sides of the file sheet holder, allowing the user to insert file sheets freely into any of the slits on either of the two sides without having that file sheet emerge through a slit on the opposite side. Without such a flap, the user must carefully insert one of the file sheets into the top slit on either of the said two sides of the file sheet holder, making sure the file sheet slides down in between the two sides without emerging through a slit on either side. This is easily done by using one finger at the top or bottom to separate the said two sides. Once a single file sheet is entered in the top slit on either of the two sides, it acts to separate the two sides. Other file sheets can be inserted in any other slits on either of the two sides without emerging on the opposite side. However a folded-in flap as described here may prove to be the preferred embodiment. Such a flap prevents even the first file sheet, inserted at random in any of the slits on either of the two sides, from emerging through the slits on the opposite side. This adds appreciably to the ease of use of the invention, and the marketplace may determine that it is the preferred embodiment.

(e) File sheets and file sheet holders may be constructed of any suitable material, such as paper, card stock or cardboard for smaller versions, and plastic, metal and laminated board for larger easel-mounted or wall-mounted versions, and all possible materials are considered part of the invention. Moreover, the embodiment in plasticized paper, as defined above, or other such wrinkle-resistant, tear-resistant, water-resistant material, is considered an integral part of this invention because it allows embodiment in small sizes with excellent durability and functionality.

(f) The T-top shape of the file sheets can be replaced by a V-top shape or any other shape that accomplishes the same purpose. The invention does not depend on the T-top shape itself, but rather on any shape which has a large portion that is not as wide as the slits in horizontal extension, and a small portion at the top that is wider than the slits in horizontal extension. The invention comprises any such shape that prevents a small portion of the file sheets from passing through the slits.

(g) The file sheets and the file sheet holders may be blank, or they can be imprinted in any ornamental or functional way. Specifically, the file sheets may be imprinted to organize specific information, such as to do lists, priority lists, expense sheets, billable hours sheets, etc. Such imprinted sheets can be sold together with the main invention, or as separate add-on items.

(h) Although plasticized paper is very durable, the information handler and project manager can also be easily repaired. Damaged file sheets can be replaced by other file sheets and, in cases where file sheet holders are bound on openable rings, the file sheet holders can be replaced easily by other file sheet holders.

(i) Although die-cutting is the typical means to shape paper and paper-like products, any other manufacturing process can also be used that will result in the same finished file sheets and file sheet holders. Alternate manufacturing systems can be used on any size of information handler and project manager, but alternate systems are more likely on larger systems that are easel-mounted, wall-mounted, etc.

Advantages

From the description above, a number of advantages of this information handling and project management system become evident:

(a) Users can have a small, easily workable, very durable system for taking in, storing and retrieving information while using the natural, handwritten pen- or pencil-and-paper mode.

(b) Users can have such a system which allows quick and easy storage of said information once taken in, and rapid, random access to such information by titles or key words after said information is stored.

(c) With the use of plasticized or polymer paper, this information handling and project management tool can be durably and workably embodied in even shirt-pocket size, ensuring that consumers can have the invention with them at all times. Users can act immediately whenever information becomes available for notation and storage, whenever important ideas strike that need to be stored, and whenever such information and ideas, once stored, are necessary to retrieve.

(d) Such a system allows people to organize all the information needed both for business and personal use, without the fear of losing important information written on loose scraps of paper.

(e) Because the system is thin and lightweight, it can easily be combined with an appointment book and telephone/contact file, even in embodiments as small as shirt-pocket size; the single tool then can manage time and appointments, information and projects, and contacts, giving consumers unprecedented organizing power in a compact system based on natural writing.

(f) In easel-mounted, wall-mounted and other larger embodiments, the invention can help organize information for large projects and/or for workgroups, keeping all information needed available for all people who need it.

Operation—FIGS. 1, 2

With this information handler and project manager, information is written on file sheets 22 using pencil or ball point pen. A title, or key words, for the file sheet is written at the top of the sheet in the non-insertion portion 26. The insertion portion of the file sheet 28 is then inserted into a convenient slit 18 in one of the file sheet holders 16. The easiest way to insert a file sheet into a slit is to insert one of the rounded corners 24 of the file sheet first, then turn the file sheet and slide it down into the slit. In smaller embodiments, the use of plasticized or polymer paper makes the insertion and sliding action positive, due to the strength and integrity of the platicized sheet used for the file sheet holder and file sheet, as well as smooth and comfortable, due to the smooth, glossy surface of the plasticized sheets.

Once a file sheet has been written on and stored in a file sheet holder, it can be quickly retrieved when needed. The horizontally extended, vertically offset slits allow the non-insertion portions of the file sheets to show, one below the next, revealing the titles and/or key words written in this top region of each file sheet. The relevant file sheet can be found quickly. To slide the file sheet out the corner can be picked up by the fingertips, but the easiest way is to press the side of the thumb against the T-top non-insertion portion of the file sheet where the title or key words are written, then slide the sheet up an inch or so, whereupon it is much easier to pick up a corner using a finger and thumb. Similarly, in the last half inch or so of inserting a file sheet, the side of the thumb can be pressed against the T-top portion of the file sheet, and the sheet slid down into position.

CONCLUSION, RAMIFICATIONS, AND SCOPE

Accordingly, the reader will see that the information handler and project manager of this invention allows the user to keep track of information necessary at work and in private life in a random-access system based on title or key words that uses natural handwriting on paper or paper-like material. No longer need key information on scraps of paper be lost. No longer must consumers face the need to use a portable computer or PDA for random-access information storage and retrieval. By combining slits in file sheet holders with file sheets which keep their own top portions out of said slits simply by their shape, the invention supplies a new filing system mechanism that lends itself to small, compact embodiments. By combining this new mechanism with plasticized paper, or substantial equivalents, the invention allows such a compact system to be practical and functional, due to both slidability and durability. The invention has additional advantages in that:

- it permits the user to carry the shirt-pocket-sized embodiment at all times, in pocket or purse, whereby the user always has the ability to take in new information or retrieve stored information and must never resort to disorganized scraps of paper, forced attempts at memorization, etc;
- it brings the benefits of small and portable random-access storage and retrieval to people who dislike aspects of the usability of electronic organizers, or who have no need for other features included in electronic organizers;
- it makes use of inexpensive materials, allowing for markedly increased personal convenience and productivity at a low price;
- it allows long-term storage of information written on file-sheets in larger, desk-top, alphabetized sets of file sheet holders, wherein the user can retrievably store information no longer needed on a daily basis, without the need to carry bulky and heavy systems at all times;
- it allows the user to plan and track various projects by writing down and storing for repeated retrieval such information as steps of the project, deadlines for different steps, personnel involved, contact information, etc., whereby the user can easily store and retrieve information necessary for multiple projects simultaneously;
- it is thin and lightweight, which means that it can easily be combined with an appointment book and telephone/contact file, even in embodiments as small as shirt-pocket size; the single tool then can manage time and appointments, information and projects, and contacts, giving users unprecedented organizing power in a compact system based on natural writing.

Although the description above contains many specificities, these should not be construed as limiting the scope of the invention but as merely providing illustrations of some of the presently preferred embodiments of this invention. For example, a wide range of materials can be suitable for the invention, other shapes for file sheets could accomplish the same purpose as the T-top shape, the file sheets could be prevented from inserting completely into the slits by the shape of the slit rather than the shape of the file sheet, etc. Thus the scope of the invention should be determined by the appended claims and their legal equivalents, rather than by the examples given.

I claim:

1. An information handler and project manager comprising a file sheet holder, a plurality of slits in said file sheet holder, and a plurality of file sheets, each file sheet comprising in part an insertion portion, wherein said insertion portion inserts slidably downward into one of said slits in said file sheet holder, and in part a non-insertion portion having a shape that prevents said file sheet from sliding completely through said slit, wherein the non-insertion portion of said file sheet remains above said slit and in front of said file sheet holder, such that characters written on said non-insertion portion of said file sheet can be easily read with said insertion portion of the file sheet fully inserted into said slit, and wherein said slits on said file sheet holder are suitably arranged such that when a plurality of said file sheets are inserted in said slits simultaneously said non-insertion portions of said file sheets are all visible at the same time, and said characters written on the plurality of said non-insertion portions can be easily read on all said file sheets simultaneously, whereby rapid random access to a variety of information written on said file sheets and retrievably stored in said slits based on natural handwriting is provided.

2. The information handler and project manager of claim 1 wherein said non-insertion portions of said file sheets are positioned at the top of said file sheets and have a T-top shape typically comprising 5% to 25% of the vertical dimension of said file sheet, wherein said non-insertion portion is wider than the insertion portion of said file sheet, whereby said insertion portion of said file sheet inserts slidably downward into one of said slits on said file sheet holders and wherein said non-insertion portion of said file sheet is wider than the slit, and thereby is prevented from sliding through the slit.

3. The information handler and project manager of claim 1 wherein said file sheet holders comprise at least one column of said slits, and wherein said slits are vertically offset, horizontally extended and substantially horizontally aligned, and wherein the vertically offset space between said slits is a suitable distance such that, when the insertion portion of said file sheet is fully inserted into said slit, said non-insertion portion of said file sheet substantially fills said vertically offset space without covering the slit immediately above and without covering the non-insertion portion of the file sheet immediately above, whereby said non-insertion portions of all said file sheets in any given column of said slits in said file sheet holder are all visible at the same time, one below the other.

4. The information handler and project manager of claim 1 wherein a single sheet is folded once then cut with slits on both sides to create a two-sided file sheet holder.

5. The information handler and project manager of claim 4 wherein said two-sided file sheet holders are made with an extra sheet between the two sides of said file sheet holder to separate said two sides, said sheet to be one of a free-standing sheet, a horizontal extension of said file sheet holder folded inward between the two sides of said file sheet holder, or a vertical extension of one side of said file sheet holder folded downward between the two sides of said file sheet holder, whereby the insertion of said insertion portion of said file sheets into said slits in said two-sided file sheet holders is facilitated by preventing said insertion portion of said file sheet when inserted into one of said slits on one side of said file sheet holder from emerging from one of said slits on the other side of said file sheet holder.

6. The information handler and project manager of claim 1, wherein a single sheet is folded more than once in any suitable way such that a plurality of two-sided file sheet holders result, the whole folded in such a way that the the said plurality of two-sided file sheet holders can be stitched or glued into a suitable cover.

7. The information handler and project manager of claim 6, wherein each of said plurallity of two-sided file sheet holders has a free-standing sheet inserted between the two sides, or a vertical extension of one side of each of said file sheet holders folded downward between the two sides.

8. The information handler and project manager of claim 1 made of any suitable material.

9. The information handler and project manager of claim 1 wherein the material of any of said file sheets and said file sheet holders is one of plasticized paper or polymer paper.

10. The information handler and project manager of claim 1 wherein any of said file sheets and said file sheet holders is paper-like, paper-thin and paper-light, with smooth feel, smooth slidability, durability, wrinkle resistance, tear resistance, and impermeability to water and oil.

11. The information handler and project manager of claim 1 wherein any of said file sheet holders are are enclosed in covers, wherein said covers may comprise one of a hard-back book cover, an appointment book cover, a flexible plastic cover, a hard plastic cover, and any other suitable cover.

12. The information handler and project manager of claim 1 wherein said file sheet holders are bound together, wherein such bindings may comprise one of smythe-sewn binding, machine-stitch binding, saddle-stitch binding, metal wire binding, plastic spiral binding, glued binding, and any other suitable binding.

13. The information handler and project manager of claim 1 wherein any of said file sheet holders are not bound and are free-standing, wherein such free-standing file sheet holder may comprise a configuration such as one of positioned flat on a tabletop, positioned flat on a desktop, inclined on an easel, mounted on a wall, and in any other suitable configuration.

14. The information handler and project manager of claim 1 wherein said file sheets have rounded corners, whereby durability is increased and insertability improved.

15. The information handler and project manager of claim 1 wherein said slits in said file holders are rounded at each end and any holes cut in said file holders, for binding rings or for any other purpose, are round or rounded, whereby the rounded internal shapes will resist tearing of the material when it is stressed.

16. The information handler and project manager of claim 1 wherein said file sheets are imprinted to facilitate specific uses, whereby the user will get specific functionalities usually associated only with specialized products.

* * * * *